United States Patent [19]

Ueda et al.

[11] Patent Number: 4,678,474

[45] Date of Patent: Jul. 7, 1987

[54] METHOD FOR IMPROVING COLOR FASTNESS OF REACTIVE DYES ON CELLULOSE WITH ALLYLAMINE COPOLYMER

[75] Inventors: Toshio Ueda; Kenji Kageno, both of Koriyama; Susumu Harada, Tokyo, all of Japan

[73] Assignee: Nitto Boseki Co., Ltd, Fukushima, Japan

[21] Appl. No.: 844,809

[22] Filed: Mar. 27, 1986

[30] Foreign Application Priority Data

Apr. 1, 1985 [JP] Japan ..... 60-68795

[51] Int. Cl.[4] ..... D06P 5/08; C09B 62/00

[52] U.S. Cl. ..... 8/543; 8/554; 8/602; 8/606; 8/918

[58] Field of Search ..... 8/554, 602, 543, 554, 8/602, 606

[56] References Cited

U.S. PATENT DOCUMENTS 4,583,989 4/1986 Ueda et al. ..... 8/543

*Primary Examiner*—A. Lionel Clingman

*Attorney, Agent, or Firm*—Bert J. Lewen; Henry Sternberg

[57] ABSTRACT

The present invention relates to a method for improving the color fastness of a dyed product which comprises treating a dyed product which has been dyed with a reactive dye with a copolymer of an N-substituted secondary allylamine derivative represented by the following general formula:

$$CH_2{=}CH{-}CH_2{-}HN{-}R.HX$$

wherein R represents a hydrocarbon group of a substituted hydrocarbon group and HX represents an inorganic or organic acid, and allylamine, diallylamine or dimethyldiallylammonium chloride.

The dyed product treated according to the method of the present invention satisfies the following requirements on performances: (1) a sufficient maintenance to fastness to chlorine, (2) a satisfactory resistance to acid hydrolysis, (3) freeness from the color change due to the treatment, (4) freeness from the decrease in fastness to light and (5) high fastnesses to water and washing.

4 Claims, No Drawings

METHOD FOR IMPROVING COLOR FASTNESS OF REACTIVE DYES ON CELLULOSE WITH ALLYLAMINE COPOLYMER

INDUSTRIAL FIELD OF THE INVENTION

The present invention relates to a method for improving the color fastness of a dyed product which has been dyed with a reactive dye.

PRIOR ART

Since dyed products which have been dyed with a reactive dye are clear in color and excellent in the color fastness to water, reactive dyes have become largely used for dyeing cellulosic fiber materials in place of direct dyes and the like.

PROBLEMS TO BE SOLVED BY THE INVENTION

However, regarding the color fastness of a dyed product which has been dyed with a reactive dye, the color fastness to chlorine must be referred to as the most important problem. Thus, when the dyed product is washed, the chlorine present in service water oxidizes the dye and discolors or fades the dyed product. With the increase in the pollution of river water in the recent time and thereby caused gradual elevation of chlorine concentration in service waters, the countermeasure for the above-mentioned problem has become more and more important.

The second problem is the resistance to acid hydrolysis (the decreasing of washing fastness during the storage). When a fiber is dyed with a reactive dye, the reactive dye forms a covalent bond with the fiber and thereby is tightly linked to the fiber. However, after the dyeing, the bond is gradually broken with the lapse of time by the influence of acidic substance or the like, which results in falling-off of the dye and stain on other clothes. As a countermeasure for this problem, the dyed product is treated with an aqueous solution of cationic polymer after the dyeing process. If a condensate of dicyandiamide and a polyethylenepolyamine such as ethylenediamine, diethylenetriamine and the like is used as the cationic polymer, the resistance to acid hydrolysis is greatly improved. In this case, however, the fastness to chlorine and the fastness to light decrease, and the hue of dyed product changes.

Accordingly, concerning the dyed products dyed with reactive dyes, it is first of all desired to develop a method of treatment capable of giving a product prevented from the decrease in fastness to chlorine. Further, the treatment must not cause any discoloration and decrease in the fastness to light. Further, the treatment must give a product having a sufficient resistance to acid hydrolysis.

Means for Solution of the Problem

In view of the above-mentioned state of things, the present inventors have conducted an elaborated study with the aim of solving the above-mentioned problems. As the result, it has been found that the above-mentioned object can be achieved by treating the dyed product with a copolymer of a secondary allylamine derivative and allylamine, diallylamine or dimethyldiallylammonium chloride. Based on this finding, the present invention has been accomplished. Thus, the present invention provides a method for improving the color fastness of a dyed product which comprises treating a dyed product having been dyed with a reactive dye with a copolymer of an N-substituted secondary allylamine derivative and monoallylamine, diallylamine or dimethyldiallylammonium chloride.

The copolymer used in the invention is a copolymer of an N-substituted secondary allylamine derivative represented by the following general formula:

$$CH_2=CH-CH_2-NH-R \cdot HX$$

wherein R represents a hydrocarbon group or a substituted hydrocarbon group and HX represnets an inorganic or organic acid, and allylamine, diallylamine or dimethyldiallylammonium chloride. Important examples of said copolymer are as follows:

(1) N-methylallylamine hydrochloride/allylamine hydrochloride copolymer,

N-ethylallylamine hydrochloride/allylamine hydrochloride copolymer,

N-n-propylallylamine hydrochloride/allylamine hydrochloride copolymer,

N-iso-propylallylamine hydrochloride/allylamine hydrochloride copolymer,

N-n-butylallylamine hydrochloride/allylamine hydrochloride copolymer,

N-isobutylallylamine hydrochloride/allylamine hydrochloride copolymer,

N-sec-butylallylamine hydrochloride/allylamine hydrochloride copolymer,

N-tert-butylallylamine hydrochloride/allylamine hydrochloride copolymer,

N-amylallylamine hydrochloride/allylamine hydrochloride copolymer,

N-hexylallylamine hydrochloride/allylamine hydrochloride copolymer,

N-cyclohexylallylamine hydrochloride/allylamine hydrochloride copolymer,

N-benzylallylamine hydrochloride/allylamine hydrochloride copolymer,

N-hydroxyethylallylamine hydrochloride/allylamine hydrochloride copolymer;

(2)N-methylallylamine hydrochloride/diallylamine hydrochloride copolymer,

N-ethylallylamine hydrochloride/diallylamine hydrochloride copolymer,

N-n-propylallylamine hydrochloride/diallylamine hydrochloride copolymer,

N-iso-propylallylamine hydrochloride/diallylamine hydrochloride copolymer,

N-n-butylallylamine hydrochloride/diallylamine hydrochloride copolymer,

N-iso-butylallylamine hydrochloride/diallylamine hydrochloride copolymer,

N-sec-butylallylamine hydrochloride/diallylamine hydrochloride copolymer,

N-tert-butylallylamine hydrochloride/diallylamine hydrochloride copolymer,

N-amylallylamine hydrochloride/diallylamine hydrochloride copolymer,

N-hexylallylamine hydrochloride/diallylamine hydrochloride copolymer,

N-cyclohexylallylamine hydrochloride/diallylamine hydrochloride copolymer,

N-benzylallylamine hydrochloride/diallylamine hydrochloride copolymer,

N-hydroxyethylallylamine hydrochloride/diallylamine hydrochloride copolymer, (3)N-methylallylamine hydrochloride/dimethyldiallylammonium chloride copolymer, N-ethylallylamine hydrochloride/dimethyldiallylammonium chloride copolymer, N-n-propylallylamine hydrochloride/dimethyldiallylammonium chloride copolymer, N-iso-propylallylamine hydrochloride/dimethyldiallylammonium chloride copolymer, N-n-butylallylamine hydrochloride/dimethyldiallylammonium chloride copolymer, N-iso-butylallylamine hydrochloride/dimethyldiallylammonium chloride copolymer, N-sec-butylallylamine hydrochloride/dimethldiallylammonium chloride copolymer, N-tert-butylallylamine hydrochloride/dimethyldiallylammonium chloride copolymer, N-amylallylamine hydrochloride/dimethyldiallylammonium chloride copolymer, N-hexylallylamine hydrochloride/dimethyldiallylammonium chloride copolymer, N-octylallylamine hydrochloride/dimethyldiallylammonium chloride copolymer, N-cyclohexylallylamine hydrochloride/dimethyldiallylammonium chloride copolymer, N-benzylallylamine hydrochloride/dimethyldiallylammonium chloride copolymer, N-hydroxyethylallylamine hydrochloride/dimethyldiallylammonium chloride copolymer.

In the above-mentioned examples of copolymer, secondary and tertiary amines have a form of hydrochloride. However, salts of other inorganic and organic acids are also usable similarly.

The copolymers can be produced by copolymerizing a salt of N-substituted secondary monoallylamine derivative and a salt of monoallylamine or various diallylamine derivatives in water or a polar solvent in the presence of a polymerization initiator having azo group in its molecule such as 2,2'-azobis(2-amidinopropane)dihydrochloride, 2,2'-azobis[2-(N-phenylamidino)propane]-dihydrochloride, 2,2'-azobis[2-(imidazolinyl)propane]-dihydrochloride, 3,5'-diamidinyl-1,2-diazo-1-cyclopentene dihydrochloride, 2,2'-azobis(2-methylpropinhydroxamic acid), 2,2'-azobis(2-methylpropaneamidoxime), 2,2'azobis(2-methylpropionic acid hydrozide) and the like. All the copolymers thus obtained are readily soluble in water.

The method of treating a dyed product with the copolymer of the invention is not critical, but hitherto known methods may be employed appropriately. For example, a dyed product to be treated is dipped in an aqueous solution containing 0.2% to 2.0% by weight (based on the weight of the dyed product) of the copolymer for a predetermined period of time, and then the dyed product is washed with water and dried. The bath ratio is usually in the range of 1:10 to 1:20; the temperature of the treatment is usually in the range from ambient temperature to 80° C.; and the duration of the treatment is usually 5 to 20 minutes.

EFFECT OF THE INVENTION

According to the method of the invention, the requirements regarding the following high performances can be satisfied: (1) a sufficient maintenance of fastness to chlorine, (2) a satisfactory resistance to acid hydrolysis, (3) freeness from color change due to the treatment, (4) freeness from the decrease in fastness to light, and (5) high fastnesses to water and washing.

In order to further illustrate the invention, a few examples of the procedure for producing the copolymer used in the invention will be presented below as "Referential Examples". Subsequently, the procedure for treating a dyed product with a copolymer of the invention and the results of the treatment will be presented as "Examples".

REFERENTIAL EXAMPLE 1

A 64.2% aqueous solution of N-ethylallylamine hydrochloride (hereinafter, abbreviated as EAA.HCl) was propared by adding 52.1 g of 35% hydrochloric acid to 42.58 g (0.5 mole) of N-ethylallylamine while cooling the reaction mixture. On the other hand, 28.54 g (0.5 mole) of allylamine was neutralized with 52.1 g of 35% hydrochloric acid while cooling the reaction mixture, and then the mixture was concentrated by means of rotary evaporator to obtain a 69.8% aqueous solution of allylamine hydrochloride (hereinafter, abbreviated as AA.HCl). Then, 18.94 g of the aqueous solution of EAA.HCl and 13.40 g of aqueous solution of AA.HCl, obtained above, were mixed together and heated to 60° C. Then, 0.645 g of 2,2'-azobis(2-amidinopropane) dihydrochloride was added, and a polymerization reaction was carried out at that temperature for 48 hours. After the reaction, the reaction mixture (a solution) was poured into a large amount of acetone to precipitate the reaction product. The precipitate was collect by filtration using a glass filter and dried at 50° C. under reduced pressure. Thus, a copolymer of N-ethylallylamine hydrochloride and allylamine hydrochloride was obtained.

REFERENTIAL EXAMPLE 2

A 66.7% aqueous solution of N-iso-propylallylamine hydrochloride (hereinafter, abbreviated as i-PAA.HCl) was prepared by adding 52.1 g of 35% hydrochloric acid to 49.6 g (0.5 mole) of N-iso-propylallylamine while cooling the reaction mixture. On the other hand, 48.58 g (0.5 mole) of diallylamine was neutralized with 52.1 g of 35% hydrochloric acid while cooling the reaction mixture to obtain a 66.4% aqueous solution of diallylamine hydrochloride (hereinafter, abbreviated as DAA.HCl). Then, 20.34 g (0.1 mole) of the aqueous solution of i-PAA.HCl and 20.14 g (0.1 mole) of the aqueous solution of DAA.HCl, obtained above, were mixed together and heated to 60° C. Then, as a polymerization initiator, 0.809 g 2,2'-azobis(2-amidinopropane) dihydrochloride was added, and a polymerization was carried out at that temperature for 48 hours. After the reaction, the reaction mixture (a solution) was poured into a large amount of acetone to precipitate the reaction product. The precipitate was collected by filtration using a glass filter and dried under reduced pressure. Thus, a copolymer of N-isopropylallylamine hydrochloride and diallylamine hydrochloride was obtained.

REFERENTIAL EXAMPLE 3

While cooling the reaction mixture, 52.1 g of 35% hydrochloric acid was added to 56.6 g (0.5 mole) of N-sec-butylallylamine to obtain 108.7 g of a 68.84% aqueous solution of N-sec-butylallylamine hydrochloride (hereinafter, abbreviated as s-BAA.HCl). After diluting 21.74 g (0.1 mole) of the latter solution with 13.98 g of water, 16.17 g of dimethyldiallylammonium chloride (hereinafter, abbreviated as DMDA AmCl) was dissolved thereinto to prepare an aqueous solution having a monomer concentration of 60%. After heating the solution to 60° C., 0.934 g of 2,2'-azobis(2-amidinopropane) dihydrochloride was added as a polymerization initiator, and a polymerization reaction was carried out at that temperature for 48 hours. After the reaction, the reaction mixture (a solution) was poured into a large amount of acetone to precipitate the reaction product. The precipitate was collected by filtration using a glass filter and then dried under reduced pressure. Thus, a copolymer of N-sec-butylallylamine hydrochloride and dimethyldiallylammonium chloride was obtained.

All the other copolymers shown in Table 1 were prepared by the same procedure as metnioned in Referential Examples 1 to 3.

EXAMPLE 1

Each of the copolymers shown in Table 1 was made into a 0.075% aqueous solution. Then, a dyed cloth (cotton) dyed by dipping process using the reactive dyes mentioned below at a dye concentration of 4% (based on the weight of fiber) was dipped in the copolymer solution at a temperature of 50° C. for a period of 20 minutes at a bath ratio of 1:20. Then, the cloth was washed with water and air-dried. The dyes used were Remazol Black B (trade name of Hoechst AG), Cibacrolan Navy Blue TRBE (trade name of Ciba-Ceigy) and Levafix Darkgreen E-3BLA (trade name of Bayer AG).

Then, the fastnesses to chlorine of the cloths thus treated were tested by the following two methods.

Method 1: A test cloth was dipped into a buffer solution having a pH value of 7.5±0.2 and containing 100 ppm of effective chlorine at a bath ratio of 1:100, and it was treated in a washing tester at 25° C. for 2 hours. Subsequently, it was rinsed with running water for 3 minutes, dewatered and dried.

Method 2: A test cloth was introduced into a domestic washing machine and continuously washed with water at room temperature for 60 minutes at a water (service water of Tokyo Prefecture) flow rate of 6 liters/minute.

The results were as shown in Table 2. According to Method 1, the treated dyed cloth is markedly improved in the fastness to chlorine as compared with the untreated dyed cloth. According to Method 2, the fastness to chlorine is retained on the original level or somewhat improved.

TABLE 1

| No. of copolymer | Name of copolymer | Molar ratio of monomers | Intrinsic viscosity of copolymer |
|---|---|---|---|
| 1 | N—Methylallylamine hydrochloride/Allylamine hydrochloride | 0.5/0.5 | 0.15 |
| 2 | N—Ethylallylamine hydrochloride/Allylamine hydrochloride | 0.5/0.5 | 0.19 |
| 3 | N—n-Propylallylamine hydrochloride/Allylamine hydrochloride | 0.5/0.5 | 0.18 |
| 4 | N—iso-Propylallylamine hydrochloride/ Allylamine hydrochloride | 0.5/0.5 | 0.23 |
| 5 | N—n-Butylallylamine hydrochloride/Allylamine hydrochloride | 0.5/0.5 | 0.19 |
| 6 | N—iso-Butylallylamine hydrochloride/ Allylamine hydrochloride | 0.5/0.5 | 0.19 |
| 7 | N—sec-Butylallylamine hydrochloride/ Allylamine hydrochloride | 0.5/0.5 | 0.26 |
| 8 | N—tert-Butylallylamine hydrochloride/ Allylamine hydrochloride | 0.5/0.5 | 0.25 |
| 9 | N—Cyclohexylallylamine hydrochloride/ Allylamine hydrochloride | 0.5/0.5 | 0.26 |
| 10 | N—Methylallylamine hydrochloride/ Diallylamine hydrochloride | 0.5/0.5 | 0.30 |
| 11 | N—Ethylallylamine hydrochloride/Diallylamine | 0.5/0.5 | 0.37 |
| 12 | N—n-Propylallylamine hydrochloride/ Diallylamine hydrochloride | 0.5/0.5 | 0.25 |
| 13 | N—iso-Propylallylamine hydrochloride/ Diallylamine hydrochloride | 0.5/0.5 | 0.33 |
| 14 | N—n-Butylallylamine hydrochloride/ Diallylamine hydrochloride | 0.5/0.5 | 0.30 |
| 15 | N—iso-Butylallylamine hydrochloride/ Diallylamine hydrochloride | 0.5/0.5 | 0.29 |
| 16 | N—sec-Butylallylamine hydrochloride/ Diallylamine hydrochloride | 0.5/0.5 | 0.32 |
| 17 | N—tert-Butylallylamine hydrochloride/ Diallylamine hydrochloride | 0.5/0.5 | 0.32 |
| 18 | N—Cyclohexylallylamine hydrochloride/ Diallylamine hydrochloride | 0.5/0.5 | 0.40 |
| 19 | N—Methylallylamine hydrochloride/ Dimethyldiallylammonium chloride | 0.65/0.35 | 0.20 |
| 20 | N—Ethylallylamine hydrochloride/ Dimethyldiallylammonium chloride | 0.65/0.35 | 0.29 |
| 21 | N—n-Propylallylamine hydrochloride/ Dimethyldiallylammonium chloride | 0.65/0.35 | 0.39 |
| 22 | N—iso-Propylallylamine hydrochloride/ Dimethyldiallylammonium chloride | 0.65/0.35 | 0.30 |
| 23 | N—n-Butylallylamine hydrochloride/ Dimethyldiallylammonium chloride | 0.65/0.35 | 0.40 |
| 24 | N—iso-Butylallylamine hydrochloride/ Dimethyldiallylammonium chloride | 0.65/0.35 | 0.38 |
| 25 | N—sec-Butylallylamine hydrochloride/ Dimethyldiallylammonium chloride | 0.65/0.35 | 0.25 |
| 26 | N—tert-Butylallylamine hydrochloride/ | 0.65/0.35 | 0.25 |

TABLE 1-continued

| No. of copolymer | Name of copolymer | Molar ratio of monomers | Intrinsic viscosity of copolymer |
|---|---|---|---|
| 27 | Dimethyldiallylammonium chloride N—Cyclohexylallylamine hydrochloride/ Dimethyldiallylammonium chloride | 0.65/0.35 | 0.27 |

TABLE 2

| Copolymer No. | Remazol Black B | | Cibacrolan Navy Blue TRBE | | Levafix Darkgreen E-3BLA | |
|---|---|---|---|---|---|---|
| | Method 1 | Method 2 | Method 1 | Method 2 | Method 1 | Method 2 |
| None | 1 | 3–4 | 1 | 3 | 1 | 3 |
| 1 | 5 | 4 | 3 | 4 | 4 | 3 |
| 2 | 5 | 4 | 3 | 4 | 4 | 3 |
| 3 | 5 | 4 | 4 | 3 | 4 | 3 |
| 4 | 5 | 4 | 4 | 3 | 4 | 3 |
| 5 | 5 | 4 | 4 | 4 | 4 | 4 |
| 6 | 5 | 4 | 4 | 4 | 4 | 4 |
| 7 | 5 | 4 | 4 | 4 | 4 | 4 |
| 8 | 5 | 4 | 4 | 4 | 4 | 4 |
| 9 | 5 | 4 | 4 | 4 | 4 | 4 |
| 10 | 5 | 4 | 3 | 4 | 4 | 3 |
| 11 | 5 | 4 | 4 | 4 | 4 | 3 |
| 12 | 5 | 4 | 4 | 4 | 4 | 4 |
| 13 | 5 | 4 | 4 | 4 | 4 | 4 |
| 14 | 5 | 4 | 4 | 4 | 4 | 4 |
| 15 | 5 | 4 | 4 | 4 | 4 | 4 |
| 16 | 5 | 4 | 4 | 4 | 4 | 4 |
| 17 | 5 | 4 | 4 | 4 | 4 | 4 |
| 18 | 5 | 4 | 4 | 4 | 4 | 4 |
| 19 | 4 | 3–4 | 3 | 4 | 3 | 3 |
| 20 | 4 | 3–4 | 3 | 4 | 3 | 3 |
| 21 | 4 | 3–4 | 3 | 4 | 3 | 4 |
| 22 | 4 | 3–4 | 3 | 4 | 3 | 4 |
| 23 | 4 | 3–4 | 3 | 4 | 3 | 3 |
| 24 | 4 | 3–4 | 3 | 4 | 3 | 3 |
| 25 | 4 | 3–4 | 3 | 4 | 3 | 4 |
| 26 | 4 | 3–4 | 3 | 4 | 3 | 4 |
| 27 | 4 | 3–4 | 3 | 4 | 3 | 4 |

EXAMPLE 2

The copolymers Nos. 1–18 shown in Table 1 were made into 0.075% aqueous solutions. A dyed cloth which had been dyed by dipping process at a dye concentration of 4% based on the weight of cloth was dipped in each of the copolymer solutions at 50° C. for 20 minutes at a bath ratio of 1:20, after which it was washed with water and dried. The dyes used were Lavefix Golden Yellow EG, Levafix Brilliant Red E-4B and Levafix Blue E-3R.

Then, the resistances to acid hydrolysis of the treated cloths were evaluated by the following method, and the results were compared with that given by an untreated cloth. Thus, a test piece was dipped into a 10 g/liter solution of lactic acid and then squeezed at a squeezing ratio of 80% by the use of a squeezer, after which it was dried at 120° C. for 4 minutes. After dryness, it was put between two accompanying white cloths (one was silk and the other was cotton) and coarsely sewn together to prepare a composite test piece. Thereafter, it was tested according the Testing Method for Color Fastness to Water (JIS-L-0846).

The results were as shown in Table 3. The untreated cloth yielded a considerable stain on the accompanying white cloths in all the dyes. On the contrary, the cloths treated with the copolymers of the invention hardly yielded such a stain.

TABLE 3

| Copolymer No. | Levafix Golden Yellow EG | Levafix Brilliant Red E-4B | Levafix Blue E-3R |
|---|---|---|---|
| None | 1 | 1 | 1 |
| 1 | 5 | 5 | 5 |
| 2 | 4 | 4 | 5 |
| 3 | 4 | 4 | 5 |
| 4 | 4 | 4 | 4 |
| 5 | 5 | 4 | 5 |
| 6 | 4 | 5 | 5 |
| 7 | 4 | 5 | 5 |
| 8 | 5 | 4 | 4 |
| 9 | 4 | 5 | 4 |
| 10 | 5 | 4 | 5 |
| 11 | 4 | 4 | 5 |
| 12 | 4 | 4 | 5 |
| 13 | 4 | 5 | 4 |
| 14 | 5 | 5 | 5 |
| 15 | 5 | 5 | 5 |
| 16 | 4 | 4 | 5 |
| 17 | 4 | 4 | 4 |
| 18 | 5 | 5 | 5 |
| 19 | 5 | 5 | 5 |
| 20 | 5 | 4 | 5 |
| 21 | 5 | 5 | 5 |
| 22 | 5 | 5 | 5 |
| 23 | 5 | 4 | 5 |
| 24 | 5 | 4 | 4 |
| 25 | 5 | 4 | 5 |
| 26 | 5 | 4 | 4 |
| 27 | 5 | 4 | 5 |

EXAMPLE 3

The copolymers Nos. 1–27 shown in Table 1 were made into 0.075% aqueous solutions. A cloth which had been dyed by dipping process at dye concentration of 4% based on the weight of cloth was dipped into each of the aqueous solutions of the copolymers at 50° C. for 20 minutes at a bath ratio of 1:20, after which it was washed with water and dried. The dyes used were Remazol Black B (trade name), Remazol Turquoise Blue G (trade name) and Levafix Brilliant Red E-4B (trade name).

Then, the trated cloths were tested for light fastness for a period of 20 hours by means of FadeOmeter according to the procedure of JIS-L-0842. The results were as shown in Table 4. In the test pieces treated with the copolymers of the invention, no decrease in the fastness to light was observed at all.

TABLE 4

| Copolymer No. | Remazol Black B | Remazol Turquoise Blue G | Levafix Brilliant Red E-4B |
|---|---|---|---|
| None | Grade 4 | Grade 4 | Grade 4 |
| 1 | " | " | " |
| 2 | " | " | " |
| 3 | " | " | " |
| 4 | " | " | " |
| 5 | " | " | " |
| 6 | " | " | " |
| 7 | " | " | " |
| 8 | " | " | " |
| 9 | " | " | " |

TABLE 4-continued

| Copolymer No. | Remazol Black B | Remazol Turquoise Blue G | Levafix Brilliant Red E-4B |
|---|---|---|---|
| 10 | " | " | " |
| 11 | " | " | " |
| 12 | " | " | " |
| 13 | " | " | " |
| 14 | " | " | " |
| 15 | " | " | " |
| 16 | " | " | " |
| 17 | " | " | " |
| 18 | " | " | " |
| 19 | " | " | " |
| 20 | " | " | " |
| 21 | " | " | " |
| 22 | " | " | " |
| 23 | " | " | " |
| 24 | " | " | " |
| 25 | " | " | " |
| 26 | " | " | " |
| 27 | " | " | " |

We claim:

1. A method for improving the color fastness of a dyed cellulosic fiber having been dyed with a reactive dye which comprises treating the dyed product with a copolymer of an N-substituted secondary allylamine derivative represented by the following general formula:

$$CH_2{=}CH{-}CH_2{-}NH{-}R \,.\, HX$$

wherein R represents a hydrocarbon group or a substituted hydrocarbon group and HX represents an inorganic or organic acid, and allylamine, diallylamine or dimethyldiallylammonium chloride.

2. A method according to claim 1, wherein said copolymer is a copolymer of allylamine hydrochloride and an N-substituted secondary allylamine derivative selected from the group consisting of N-methylallylamine hydrochloride, N-ethylallylamine hydrochloride, N-n-propylallylamine hydrochloride, N-isopropylallylamine hydrochloride, N-n-butylallylamine hydrochloride, N-isobutylallylamine hydrochloride, N-sec-butylallylamine hydrochloride, N-tert-butylallylamine hydrochloride and N-cyclohexylallylamine hydrochloride.

3. A method according to claim 1, wherein said copolymer is a copolymer of diallylamine hydrochloride and an N-substituted secondary allylamine derivative selected from the group consisting of N-methylallylamine hydrochloride, N-ethylallylamine hydrochloride, N-n-propylallylamine hydrochloride, N-iso-propylallylamine hydrochloride, N-n-butylallylamine hydrochloride, N-iso-butylallylamine hydrochloride, N-sec-butylallylamine hydrochloride, N-tert-butylallylamine hydrochloride and N-cyclohexylallylamine hydrochloride.

4. A method according to claim 1, wherein said copolymer is a copolymer of dimethyldiallylammonium chloride and an N-substituted secondary allylamine derivative selected from the group consisting of N-methylallylamine hydrochloride, N-ethylallylamine hydrochloride, N-n-propylallylamine hydrochloride, N-isopropylallylamine hydrochloride, N-n-butylallylamine hydrochloride, N-iso-butylallylamine hydrochloride, N-sec-butylallylamine hydrochloride, N-tert-butylallylamine hydrochloride and N-cyclohexylallylamine hydrochloride.

* * * * *